United States Patent [19]

Sato et al.

[11] Patent Number: 4,595,357

[45] Date of Patent: Jun. 17, 1986

[54] CONTINUOUS ANNEALING METHOD AND APPARATUS FOR COLD ROLLED STEEL STRIPS

[75] Inventors: Kuniaki Sato; Yasuhisa Nakajima; Naohiko Soeda; Norio Ohta; Atsushi Nagashima, all of Chiba, Japan

[73] Assignee: Kawasaki Steel Corporation, Kobe, Japan

[21] Appl. No.: 730,282

[22] Filed: May 3, 1985

[30] Foreign Application Priority Data

May 4, 1984 [JP] Japan ..... 59-89930
May 4, 1984 [JP] Japan ..... 59-89931

[51] Int. Cl.[4] ..... F27B 9/28; C21D 9/54

[52] U.S. Cl. ..... 432/8; 266/103; 432/59

[58] Field of Search ..... 432/8, 59; 266/102, 266/103

[56] References Cited

U.S. PATENT DOCUMENTS 2,706,625 4/1955 Lorig ..... 432/59
3,181,977 5/1965 Sturgeon ..... 432/8
4,364,728 12/1982 Stamp ..... 432/59
4,379,547 4/1983 Shimbashi et al. ..... 266/103

FOREIGN PATENT DOCUMENTS 56-152932 11/1981 Japan ..... 266/103

*Primary Examiner*—John J. Camby
*Attorney, Agent, or Firm*—Balogh, Osann, Kramer, Dvorak, Genova & Traub

[57] ABSTRACT

A method and an apparatus for continuously annealing cold rolled steel strips successively passing through a preheating zone, a low temperature heating zone, a high temperature heating soaking zone, a primary cooling zone and a secondary cooling zone. In each zone, the steel strip is driven by hearth rolls alternately upward and downward in a serpentine path. According to the invention, in a high temperature zone such as the high temperature heating zone and the primary cooling zone where the steel strip is prone to heat buckling, the steel strip is caused to pass only once in a single direction without passing along the serpentine path, thereby preventing meandering and heat buckling of the steel strip.

16 Claims, 17 Drawing Figures

CONTINUOUS ANNEALING METHOD AND APPARATUS FOR COLD ROLLED STEEL STRIPS

BACKGROUND OF THE INVENTION

1. Field of the Invention

This invention relates to a continuous annealing method and a continuous annealing apparatus for cold rolled steel strips, and more particularly to a method and an apparatus for continuously annealing steel strips in a manner effectively preventing meandering and heat buckling of the strips during heat-treatment.

2. Description of the Prior Art

In general, continuous annealing furnaces for cold rolled steel strips are of a vertical type in view of the cost and area for providing the furnaces. In such vertical continuous annealing furnaces, a number of hearth rolls 1 are arranged in upper and lower portions of the furnace 2. A steel strip S is trained around these upper and lower hearth rolls alternately upward and downward in a serpentine path during which these steel strips S are subjected to predetermined heat-treatment required to obtain their material characteristics as shown in FIG. 1.

In continuously heat-treating steel strips in furnaces in such a manner, however, the steel strips often undergo meandering to obstruct smooth operation probably owing to particular shapes of the steel strips or unbalance in tensile force in the steel stripe or particular temperature conditions in the furnaces In order to prevent the meandering, crown or tapered rolls 1' or 1'' as hearth rolls have been usually used, which include tapered ends as shown in FIGS. *2a* and *2b*, which cause centering forces urging the steel strip toward maximum diameter portions of the rolls at their center to prevent the meandering of the strip. However, the centering force tends to exceed a certain level to cause buckling of the strip in its width direction resulting in defects of the steel products, called "heat buckling".

In order to prevent the meandering and heat buckling in this case, therefore, it is required to provide crowning or tapered amount on the rolls so as not to cause the meandering and heat buckling of the strips. However, it is very difficult to determine the crowning or tapered amount because they are caused by various parameters. For example, the heat buckling will increase, the higher the temperature of the heat-treatment, the wider and thinner the steel strips, and higher the feeding speeds of the strips in the furnaces.

Hearth rolls capable of changing their crowning or tapered amounts have been proposed to solve the above problems as disclosed in Japanese Laid-open Utility Model Application No. 55-172,359, Japanese Laid-open Patent Application No. 57-177,930 and Japanese Laid-open Patent Application No. 58-105,464. In order to control the crowning or tapered amounts, however, it is required to provide measuring devices for measuring crowning amounts at every hearth rolls and control devices for controlling the crowning amounts on the basis of the measured amounts in the measuring devices. Such systems, therefore, are very expensive and include a problem of low responsibility to be solved.

Steel strips of carbon content less than 0.1% are generally used for deep drawing. As the melting technique improves, extremely low-carbon steels including carbon content of the order of less than 0.005% have been used for materials for deep drawing. These cold rolled steel plates for deep drawing are to be annealed at temperatures higher than 800° C. and tend to cause the heat buckling. Such a tendency is more acute in low-carbon steels as the carbon content becomes extremely low.

Recently, needs of very thin steel strips having thicknesses less than 0.2 mm increase for blank materials of tin plates. Such very thin steel strips tend to cause the heat buckling as the speed for feeding the strips through furnaces is increased. Moreover, blank materials of extremely low-carbon steels for soft tin plates often cause the problem of heat buckling.

SUMMARY OF THE INVENTION

FIG. 3 schematically illustrates a hitherto used continuous annealing furnace suitable for continuously heat-treating blank materials of tin plates. This furance includes a heating zone 3, a soaking zone 4, a slow cooling zone 5 and a rapid cooling zone 6, through which a steel strip S passes progressively to be subjected to predetermined heat-treatment.

FIGS. *4a* and *4b* illustrate frequencies in occurrence of meandering and heat buckling of steel strips annealed in the continuous annealing furnace shown in FIG. 3 in relationship with crowning amounts of hearth rolls in upstream and downstream halves of the heating zone, the soaking zone, and the slow and quick cooling zones.

As can be seen from these graphs, the heat buckling tends to occur in the high temperature zones such as the downstream half in the heating zone, the soaking zone and the slow cooling zone, while the meandering of steel strips is restrained in these high temperature zones.

FIG. 5 schematically illustrates a hitherto used continuous annealing line including a continuous annealing furnace for steel strips to be deep drawn. In the drawing, a steel strip S is wound off at pay-off reels 7 and 7' and is subjected to pretreatment in a device 8 located on an entry side such as a welder or cleaning device and thereafter is fed through a looper on the entry side into the continuous annealing furnace 10. The steel strip S is subjected to predetermined heat-treatments while progressively passing through a preheating zone 11, a heating zone 12, a soaking zone 13, a primary cooling zone 14, a secondary cooling zone 15, an overaging treating zone 16 and a third cooling zone 17, and is then fed through a looper 18 on an exit side into a treating device 19 such as a shearer for after-treatment. Thereafter, the steel strip is wound up on tension reels 20 and 20'.

FIG. 6 shows rates or percenages of occurrence of heat buckling of steel strips to be deep drawn when subjected to heat-treatment in the continuous annealing furnace shown in FIG. 5. An abscissa shows heating temperatures of the strips and an ordinate shows percentages of the number of coils which caused heat buckling to the number of all the treated coils.

As can be seen from FIG. 6, the heat buckling does not occur at temperatures of the steel strips lower than 780° C., but the heat buckling rapidly increase as the temperature higher than 780° C. becomes more higher.

FIG. 7 also illustrates heat buckling in case of extremely low-carbon blank strips (0.2–0.3 mm thickness) for tin plates in the same manner.

As can be seen from FIG. 7, with the extremely low-carbon blank strips, the heat buckling considerably decreases as the treating temperature lowers, and particularly does not occur at temperatures lower than 700° C. at all.

From the above results of our investigation for preventing the heat buckling and meandering of steel strips, it has been found that the prevention of the heat buckling and meandering is effectively achieved by constituting the high temperature zones as horizontal furnaces having no hearth roll and the low temperature zones as vertical furnaces accommodating hearth rolls and by suitably controlling temperatures of the steel strips at entrance and exit sides of the horizontal furnaces, because although the hearth rolls effectively prevent the meandering of steel strips, the hearth rolls cause the heat buckling in high temperature zones in conjunction with effects of crowning due to heat, lowering of strength at high temperatures, feeding speeds of the strips and thermal expansion of the strips.

It is a principal object of the invention to provide a continuous annealing method of cold rolled steel strips and a continuous annealing apparatus suitable for carrying out the method, capable of effectively preventing meandering and heat buckling of steel strips greatly adversely affecting yield rate and quality of steel products.

In order to achieve this object, in a method of continuous annealing cold rolled steel strips successively passing through a heating, a soaking and a cooling zone, in each zone the steel strip passing alternately upward and downward in a serpentine path with the aid of rolls, according to the invention, the steel strip is caused to pass only once in a single direction in a high temperature zone where the steel strip is prone to heat buckling.

In the high temperature zone, the steel strip is fed in a substantially horizontal or vertical direction, while in each remaining zone, the steel strip is fed alternately upward and downward in the serpentine path with the aid of a number of hearth rolls.

According to the invention, the steel strip is heated in a low temperature heating zone provided adjacent to and upstream of the high temperature zone, and is further heated, soaked and cooled in a high temperature heating soaking zone and a primary cooling zone provided in the high temperature zone and thereafter the steel strip is further cooled in a secondary cooling zone provided adjacent to and downstream of the high temperature zone.

Temperatures of the steel strip immediately before entering and immediately after leaving the high temperature zone are preferably controlled so as to be kept at temperatures for example lower than 780° C. at which the heat buckling is not caused.

In an apparatus for continuously annealing cold rolled steel strips successively passing through a heating, a soaking and a cooling zone, in each zone the steel strip passing alternately upward and downward in a serpentine path with the aid of rolls, according to the invention, the apparatus comprises a high temperature zone single furnace through which the steel strip passes only once in a single direction, the high temperature zone single furnace forming therein a high temperature zone where the steel strip is prone to heat buckling.

According to the invention, the high temperature zone single furnace is a horizontal or vertical furnace.

In a preferred embodiment, the high temperature zone single furnace forms therein a high temperature heating soaking zone for heating and soaking the steel strip at high temperature and a primary cooling zone adjacent to and downstream of the high temperature heating soaking zone for primarily cooling the steel strip.

In a preferred embodiment of the invention, the high temperature zone single furnace is a horizontal furnace preferably located above a low temperature heating zone vertical furnace and the preheating zone vertical furnace or above a low temperature heating zone vertical furnace, the preheating zone vertical furnace, a secondary cooling zone vertical furnace, an overaging treating vertical furnace and a third cooling zone vertical furnace.

The invention will be more fully understood by referring to the following detailed specification and claims taken in connection with the appended drawings.

DETAILED DESCRIPTION OF THE PREFERRED EMBODIMENT

Figure 8:
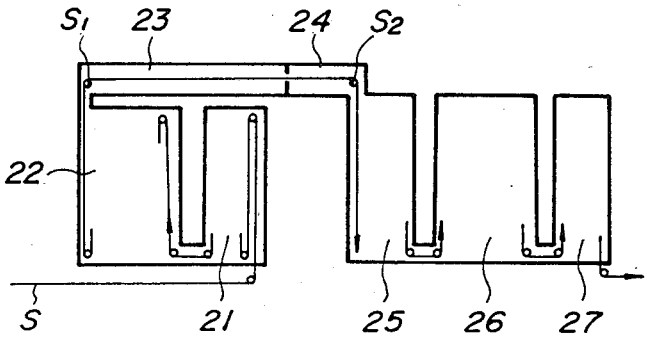
FIG. 8 is a schematic view of a continuous annealing apparatus for cold rolled steel strips for deep drawing.

FIG. 8 illustrates a preferred embodiment of a continuous annealing apparatus for cold rolled steel strips for deep drawing according to the invention. This annealing apparatus comprises a preheating zone 21, a low temperature heating zone 22 and a high temperature heating soaking zone 23 consisting of a high temperature heating zone and soaking zone. A primary cooling zone 24 horizontally continuous to the high temperature heating soaking zone 23 forms a high temperature cooling zone. The horizontal furnace indicated by the numerals 23 and 24 is located above the vertical furnaces including the preheating zone 21 and the low temperature heating zone 22. The annealing apparatus further comprises a secondary cooling zone 25, an overaging treating zone 26 and a third cooling zone 27 respectively consisting of vertical furnaces.

The high temperature heating soaking zone 23 and the primary cooling zone 24 are arranged in a horizontal single furnace without any hearth rolls to permit the steel strip to pass these zones only once in a single direction, thereby avoiding use of hearth rolls apt to cause heat buckling of steel strips in a high temperature zone.

In each of the zones other than the high temperature heating soaking zone 23 and the primary cooling zone 24, the steel strip is driven by hearth rolls alternately upward and downward in a serpentine path.

Figure 9:
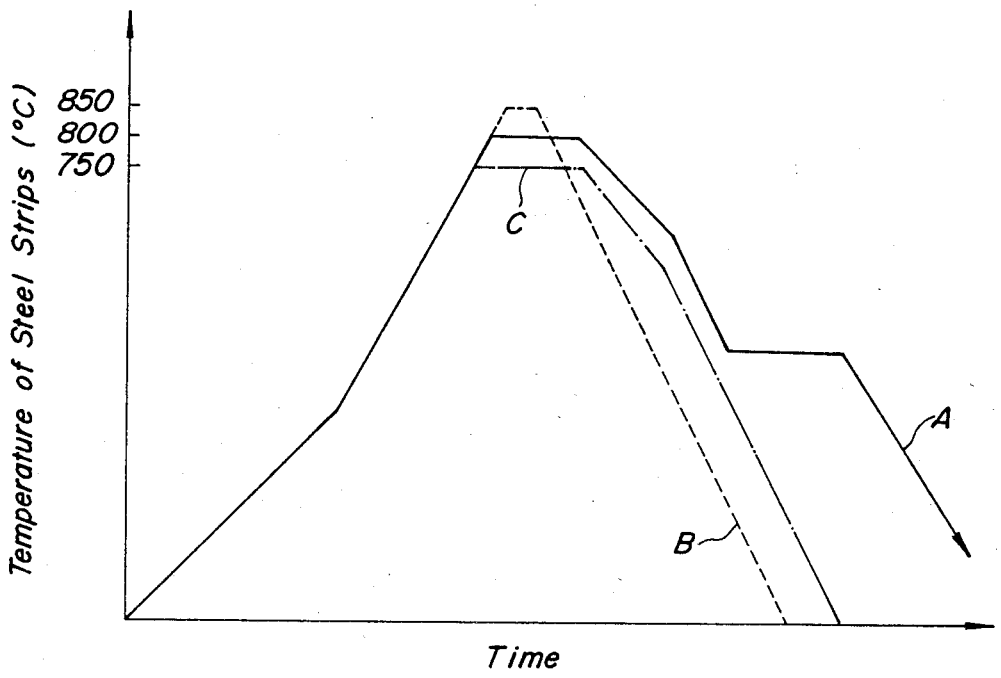
FIG. 9 illustrates heat patterns for steel strips annealed according to the invention.

With such a continuous annealing apparatus, a steel strip S is subjected to heat-treatment according to a heat pattern A as shown in FIG. 9 to obtain its predetermined material characteristics. In more detail, after the steel strip S is heated to a certain temperature in the preheating zone 21 and the low temperature heating zone 22, the steel strip S is introduced into the high temperature heating soaking zone 23 of the horizontal furnace arranged above the preheating and low temperature heating zones 21 and 22 so as to be subjected to a predetermined heat-treatment. Thereafter, the steel strip S is fed into the primary cooling zone 24 so as to permit its temperature to fall to a predetermined temperature. The steel strip is then introduced into the secondary cooling zone 25, the overaging treating zone 26 and the third cooling zones 27 in the vertical furnaces to give desired material characteristics to the strip.

Figure 1:
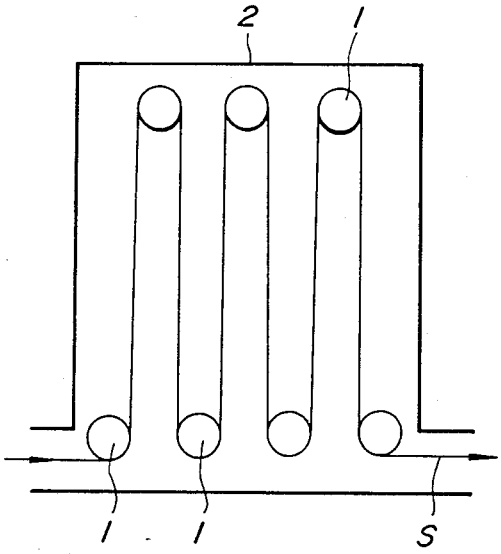
FIG. 1 PRIOR ART
FIG. 1 is a schematic view of a continuous annealing vertical furnace of the prior art.
Figure 2A:
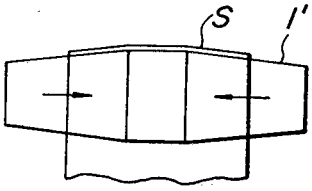
FIG. 2a PRIOR ART
FIGS. 2*a* and 2*b* are front views illustrating hitherto used crown rolls used in continuous annealing furnaces of the prior art.
Figure 2B:
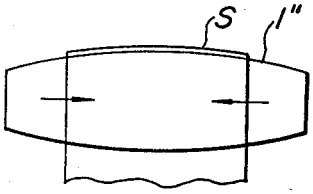
FIG. 2b PRIOR ART
Figure 3:
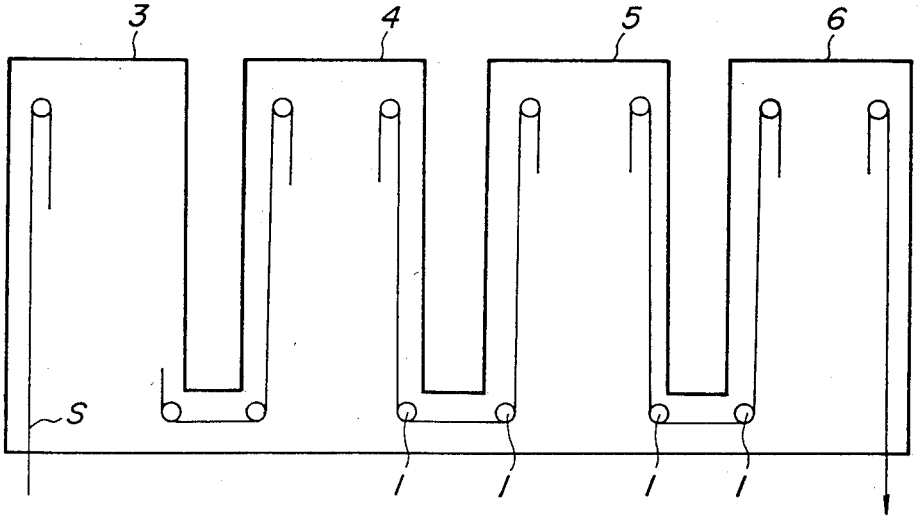
FIG. 3 PRIOR ART
FIG. 3 is a schematic view of a continuous annealing apparatus of the prior art for blank materials for tin plates.
Figure 4A:
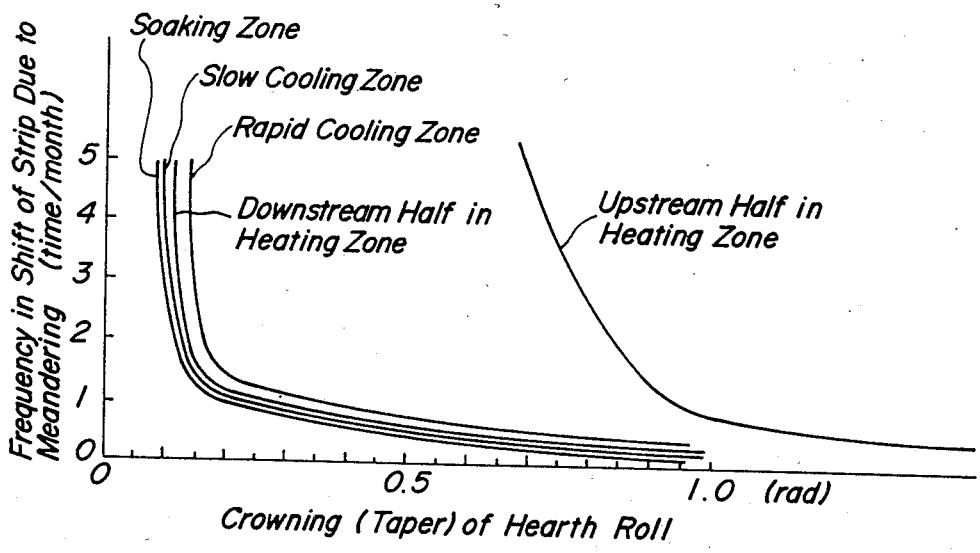
FIGS. 4*a* and 4*b* are graphs illustrating effects of crowning amount of hearth rolls on frequencies of occurrence of meandering and heat buckling of steel strips in upstream and downstream halves in heating zone, and soaking, slow cooling and rapid cooling zone.
Figure 4B:
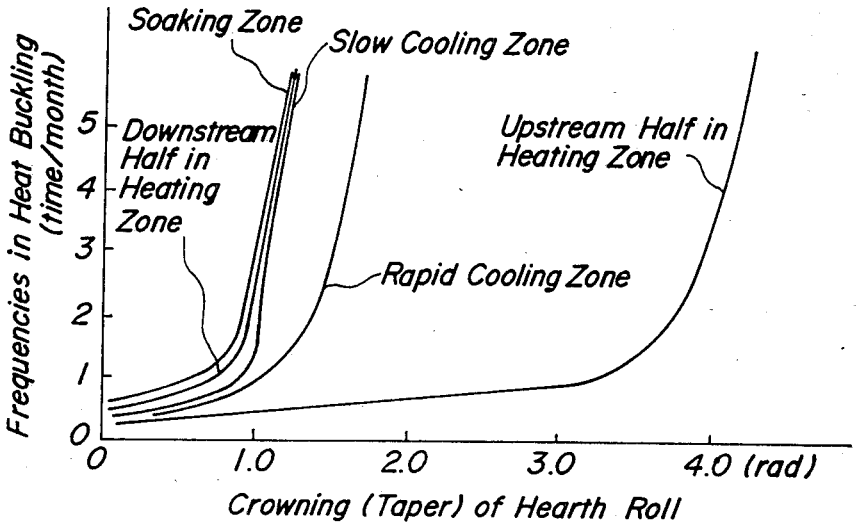
Figure 5:
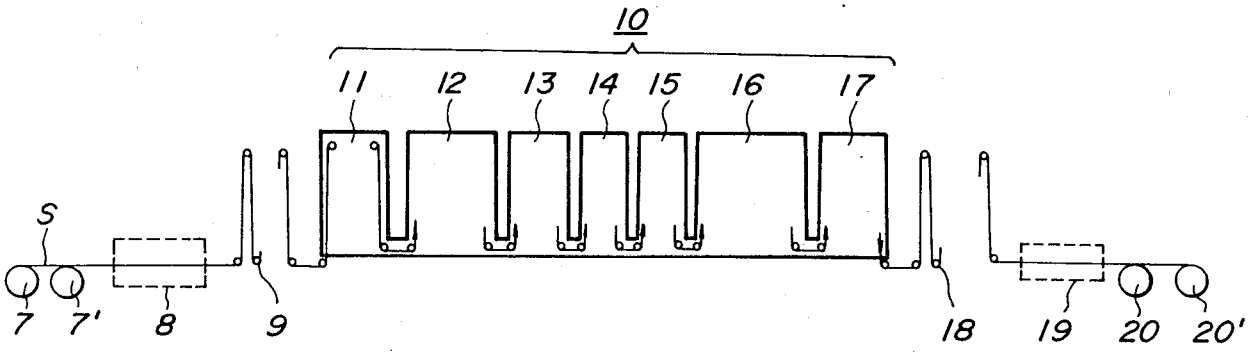
FIG. 5 is a schematic view of a continuous annealing apparatus of the prior art for cold rolled steel strips for deep drawing.
Figure 6:
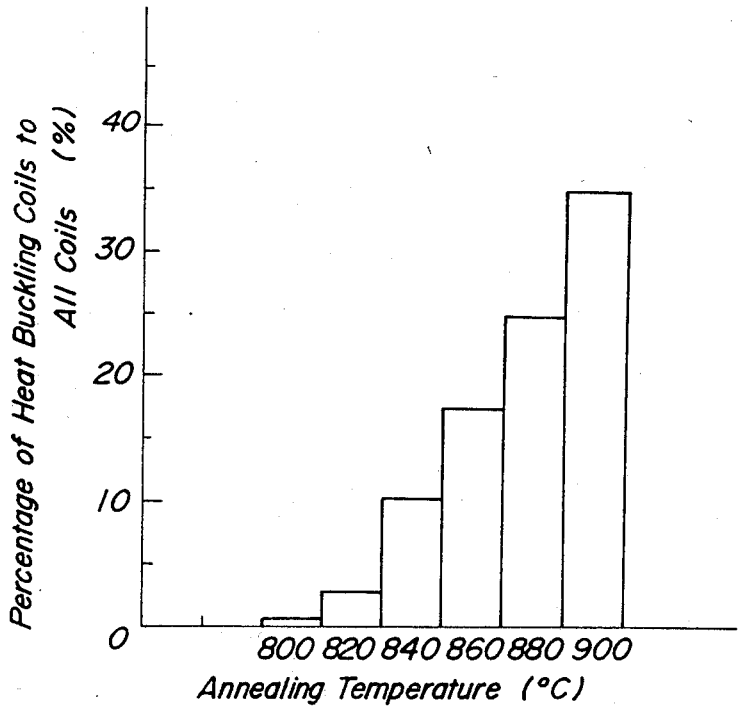
FIG. 6 is a graph illustrating percentages of heat buckling coils to all coils in relation to annealing temperatures for cold rolled steel strips for deep drawing.
Figure 7:
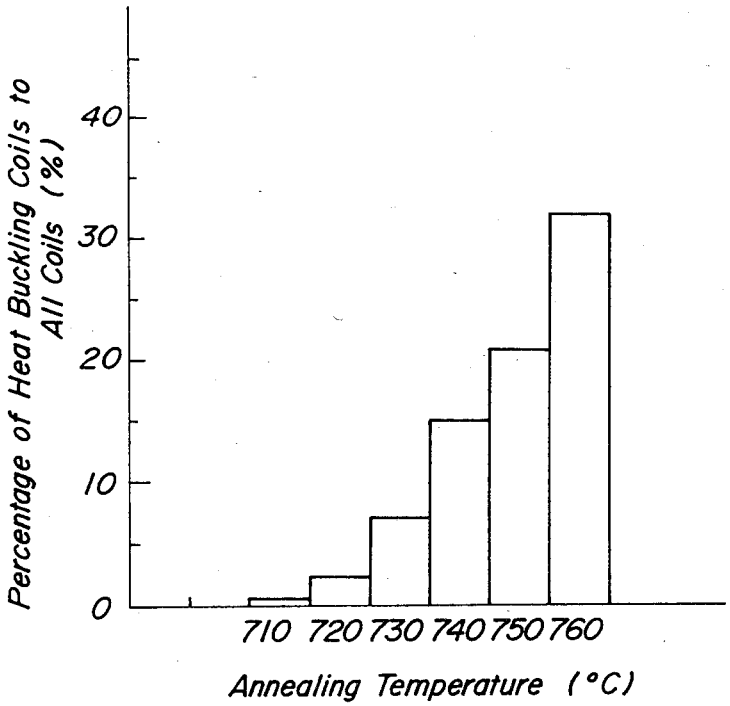
FIG. 7 is a graph illustrating percentages of heat buckling coils to all coils in relation to annealing temperature for low-carbon steel strips of extremely low-carbon content for tin plates.

In this case, it should be noticed that temperatures of the steel strips immediately before entering the high temperature heating soaking zone 23 and immediately after leaving the primary cooling zone 24 are lower than 780° C. in view of the results shown in FIG. 6 in order to prevent the heat buckling.

Radiant tube type burners are preferably used for heating the low temperature heating zone 22 and the high temperature heating soaking zone 23. The preheating zone 21 is preferably heated directly by exhaust gasses from the zones 22 and 23 or by air which has been heat-exchanged with the exhaust gasses from the zones 22 and 23. Moreover, the primary, secondary and third cooling zones 24, 25 and 27 are preferably cooled by gas-jet cooling system using a non-oxidizing atmosphere gas, or roll cooling system using cooling rolls contacting steel strips or combination of the roll cooling and gas-jet cooling systems. The overaging treating zone 26 is preferably heated by radiant heating using electric heaters or radiant tubes.

Figure 10:
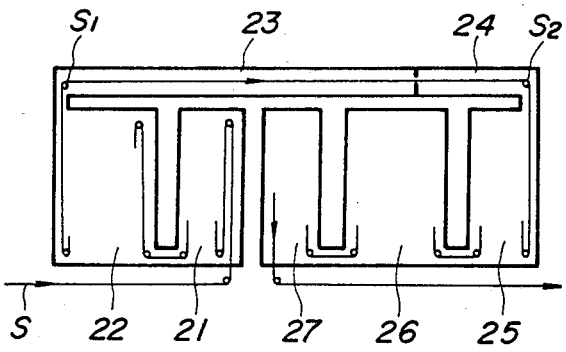
FIG. 10 is a schematic view of another embodiment of the continuous annealing apparatus according to the invention.

FIG. 10 illustrates another embodiment of the continuous annealing apparatus according to the invention preferable for cold rolled steel strips for deep drawing. In annealing steel strips for deep drawing, either of the apparatuses shown in FIGS. 8 and 10 is selected according to heating speeds or the temperature of the steel strips in the proximity of entrance of the horizontal furnace.

Figure 11:
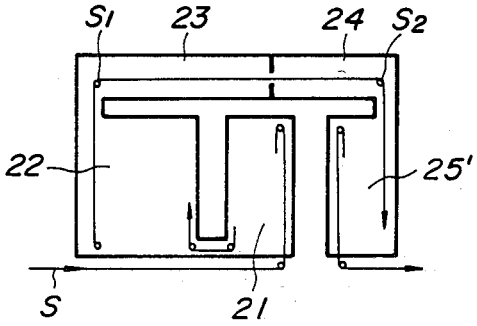
FIG. 11 is a schematic view of a further embodiment of the continuous annealing apparatus according to the invention for low-carbon steel strips of extremely low-carbon content for deep drawing.

FIG. 11 illustrates a further preferred embodiment of the continuous annealing apparatus according to the invention for cold rolled low-carbon steel strips of extremely low-carbon content for deep drawing. This apparatus is similar to that shown in FIG. 10 with the exception that a vertical furnace on a downstream side forms only a secondary cooling zone 25'.

With the apparatus shown in FIG. 11, a steel strip S passes successively a preheating zone 21, a low temperature heating zone 22 and a high temperature heating soaking zone 23 and then rapidly cooled in a primary cooling zone 24 and a secondary cooling zone 25' according to a heat pattern B shown in FIG. 9 so as to give desired material characteristics to the strip. It is of course that the temperatures of the steel strips immediately before entering and immediately after leaving the horizontal furnace forming the zones 23 and 24 are lower than 780° C.

Figure 12:
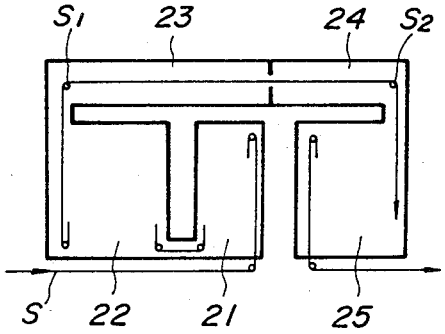
FIG. 12 is a schematic view of a continuous annealing apparatus according to the invention for extremely thin low carbon steel strips of extremely low-carbon content for tin plates.

FIG. 12 illustrates a further embodiment of the continuous annealing apparatus according to the invention suitable for very thin blank steel strips for tin plates, which are of extremely low-carbon content and have thicknesses less than 0.2 mm.

This apparatus is substantially similar to that shown in FIG. 11 with exception that a primary cooling zone 24 is a slow cooling zone and a secondary cooling zone 25 continuous thereto is a rapid cooling zone.

With this apparatus, a steel strip S is subjected to the heat-treatment according to, for example, a heat pattern C shown in FIG. 9. It is of course that the temperatures of the steel strips immediately before entering and immediately after leaving the horizontal furnace forming the zones 23 and 24 are lower than 780° C. to prevent the heat buckling.

According to the invention, the entrance into and exit of steel strips from horizontal furnace are carried out at temperatures which do not cause any heat buckling. Such temperatures cannot be indiscriminately determined because they greatly vary dependently upon the material, thicknesses of strips and the other factors. It is therefore needed to previously know temperatures at which the heat buckling would occur in consideration of materials and thicknesses of steel strips.

With the above embodiments, the high temperature zones are arranged in the horizontal furnace and the low temperature zones before and after thereof are arranged in the vertical furnaces in order to prevent the heat buckling and meandering of steel strips in continuous annealing. If rolls at an inlet and an outlet of the horizontal furnace are formed as steering rolls, the meandering of steel strips can be more effectively prevented.

If slack of the steel strip in the horizontal furnace causes any problem, support rolls or floaters may be suitably used.

Although all the apparatuses above described include the preheating zones, these zones are of course not essential.

Figure 13:
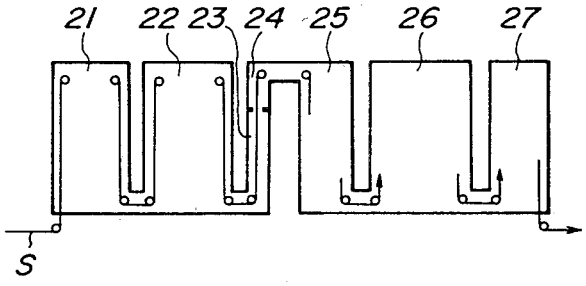
FIG. 13 is a schematic view of a further embodiment of the annealing apparatus according to the invention.

FIG. 13 shows a further embodiment of the invention, wherein a continuous annealing apparatus is similar to that shown in FIG. 8 with exception that a high temperature heating soaking zone 23 and a primary cooling zone 24 are arranged in series in a single vertical furnace to permit the steel strip to pass these zones only once in a single direction without passing along a serpentine path.

In this apparatus, a steel strip S is subjected to heat-treatment according to the heat pattern A as shown in FIG. 9 in the same manner as in the apparatus shown in FIG. 8. The steel strip S passes through this apparatus to give desired material characteristics to the strip. Moreover, heating means and cooling means may be used, which are explained in connection with the apparatus shown in FIG. 8.

Figure 14:
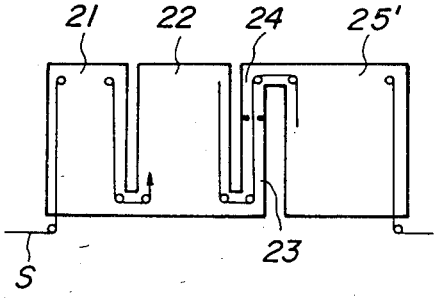
FIG. 14 is a schematic view of a continuous annealing apparatus according to the invention for low-carbon steel strips of extremely low-carbon content for deep drawing.

FIG. 14 illustrates a further embodiment of the continuous annealing apparatus preferable for cold rolled low-carbon steel strips of extremely low-carbon content of deep drawing. This apparatus is similar to that shown in FIG. 13 with the exception that a low temperature zone on a downstream side consists only of a secondary cooling zone 25'.

With the apparatus shown in FIG. 14, a steel strip S passes successively a preheating zone 21, a low temperature heating zone 22, a high temperature heating soaking zone 23, a primary cooling zone 24 and a secondary cooling zone 25' so as to be subjected to the heat-treatment according to the heat pattern B shown in FIG. 9 to give desired material characteristics to the strips.

Figure 15:
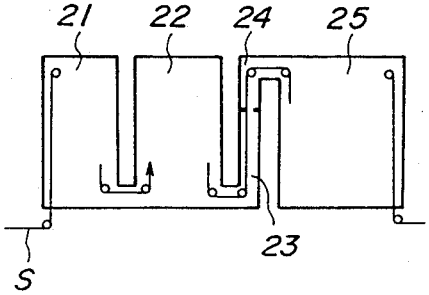
FIG. 15 is a schematic wiew of a continuous annealing apparatus according to the invention for extremely thin low-carbon steel strips of exrremely low-carbon content for tin plates.

FIG. 15 shows a continuous annealing apparatus according to the invention suitable for very thin blank steel strips for tin plates, which are of extremely low-carbon content and have thicknesses less than 0.2 mm. This apparatus is substantially similar to that shown in FIG. 14 with exception that a secondary cooling zone 25 in a vertical furnace on a downstream side is a rapid cooling zone.

With this appratus, a steel strip S is subjected to the heat-treatment according to, for example, the heat pattern C shown in FIG. 9.

EXAMPLES

Cold rolled low-carbon steel strips of extremely low-carbon content for deep drawing having sizes shown in following Tables 1 and 2 were heat-treated by the apparatuses shown in FIG. 8 for forty coils and shown in FIG. 13 for thirty coils with various temperatures in the low and high temperature zones and cooling zone as shown in the Tables.

Results of occurrence of heat buckling and meandering of the steel strips in annealing are shown in Tables 1 and 2.

TABLE 1

| Thickness of strip (mm) | Width of strip (mm) | Feeding speed (m/min) | Number of coils | Temperature (°C.) of strip at exit of each zone: Low temperature heating zone | High temperature heating soaking zone | Primary cooling zone | Occurrence of heat buckling: Number of heat buckling coils | Location of heat buckling | Occurrence of meandering: Number of meandering coils | Location of meandering |
|---|---|---|---|---|---|---|---|---|---|---|
| 0.8~1.2 | 1,240~1,560 | 400~220 | 15 | 750 | 850 | 750 | 0 | — | 0 | — |
| " | " | " | 3 | 780 | 850 | 750 | 0 | — | 0 | — |
| " | " | " | 5 | 810 | 850 | 750 | 1 | Low temperature heating zone | 0 | — |
| " | " | " | 5 | 750 | 850 | 780 | 0 | — | 0 | — |
| " | " | " | 3 | 750 | 850 | 810 | 1 | Secondary cooling zone | 0 | — |
| " | " | " | 5 | 780 | 850 | 780 | 0 | — | 0 | — |
| " | " | " | 4 | 780 | 850 | 810 | 1 | Secondary cooling zone | 0 | — |

TABLE 2

| Thickness of strip (mm) | Width of strip (mm) | Feeding speed (m/min) | Number of coils | Temperature (°C.) of strip at exit of each zone: Low temperature heating zone | High temperature heating soaking zone | Primary cooling zone | Occurrence of heat buckling: Number of heat buckling coils | Location of heat buckling | Occurrence of meandering: Number of meandering coils | Location of meandering |
|---|---|---|---|---|---|---|---|---|---|---|
| 0.8~1.2 | 1,240~1,560 | 400~200 | 11 | 750 | 850 | 750 | 0 | — | 0 | — |
| " | " | " | 4 | 780 | 850 | 750 | 0 | — | 0 | — |
| " | " | " | 2 | 810 | 850 | 750 | 1 | Low temperature heating zone | 0 | — |
| " | " | " | 4 | 750 | 850 | 780 | 0 | — | 0 | — |
| " | " | " | 3 | 750 | 850 | 810 | 1 | Secondary cooling zone | 0 | — |
| " | " | " | 4 | 780 | 850 | 780 | 0 | — | 0 | — |
| " | " | " | 2 | 780 | 850 | 810 | 1 | Secondary cooling zone | 0 | — |

As can be seen from Tables 1 and 2, the heat buckling was prevented by providing the high temperature zones in one horizontal or vertical furnace to heat, soak and primarily cool the steel strips. Moreover, the meandering was prevented by larging the crowning of hearth rolls in vertical furnaces for low temperature zones in the apparatuses shown in FIGS. 8 and 13 and by larging the crowning of upper and lower rolls in the vertical furnace of the high temperature heating soaking zones of the apparatus shown in FIG. 13.

As can be seen from the above description, according to the invention the heat buckling and meandering can be effectively prevented by arranging the high temperature zones in the horizontal furnace and the low temperature zones in the vertical furnaces or arranging the high temperature zones in the vertical furnace to avoid the contact of strips with rolls as possible. The other effects are as follows.

(1) An area to locate the continuous annealing apparatus can be reduced.

(2) As the feeding speed of steel strips can be increased without any risk of heat buckling, the productivity is increased.

(3) Variation in tensile force in steel strips in high temperature zones has caused problems in the prior art. In contrast herewith, the high temperature zones are arranged in a horizontal single furnace according to the invention, so that slack of the steel strip mitigates the variation in the tensile force in the strip.

(4) Foreign particles on steel strips in high temperature zones tend to stick on hearth rolls so as to accumulate thereon. The accumulated particles would cause surface defects in steel strips. This invention eliminates such defects.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of continuously annealing cold rolled steel strips successively passing through a heating, a soaking and a cooling zone, which method comprises heating a steel strip in an upstream half of said heating zone while it passes about hearth rolls arranged one above the other therein, subjecting the steel strip to heating, soaking and cooling treatment in a high temperature zone of a downstream half of said heating, soaking and cooling zone without passing about hearth rolls, and thereafter cooling the steel strip in a downstream half of said cooling zone while it passes about hearth rolls arranged one above the other, thereby preventing heat buckling of the steel strip in the high temperature zone.

2. A method as set forth in claim 1, wherein said steel strip is moved substantially horizontally while being subJected to the heating, soaking and cooling treatment in the high temperature zone.

3. A method as set forth in claim 1, wherein said steel strip is moved substantially vertically while being subjected to the heating, soaking and cooling treatment in the high temperature zone.

4. A method as set forth in claim 1, wherein said steel strip is heated in a low temperature heating zone provided adjacent to and upstream of said heating zone, and is further heated, soaked and cooled in the high temperature zone and a primary cooling zone provided in said high temperature zone, and thereafter said steel strip is further cooled in a secondary cooling zone provided adjacent to and downstream of said high temperature zone.

5. A method as set forth in claim 1, wherein in the downstream half of the cooling zone, the steel strip is rapidly cooled.

6. A method as set forth in claim 1, wherein the steel strip is successively subjected to cooling, overaging treatment and cooling in the downstream half of the cooling zone.

7. A method as set forth in claim 1, wherein the steel strip is successively subjected to preheating and heating in the upstream half of said heating zone.

8. A method as set forth in claim 1, wherein temperatures of said steel strip immediately before entering and immediately after leaving said high temperature zone are substantially kept at temperatures at which said heat buckling is not caused.

9. A method as set forth in claim 8, wherein said temperatures are lower than 780° C.

10. An appararus for continuously annealing cold rolled steel strips, comprising a heating furnace having a plurality of crowned hearth rolls arranged one above the other and heating means for heating the steel strip passing about said plurality of crowned hearth rolls; a heat-treatment furnace having heating means, soaking means and cooling means for heating, soaking and cooling the steel strip and having no hearth rolls about which the steel strip passes; and a cooling furnace having a plurality of crowned hearth rolls arranged one above the other and cooling means for cooling the steel strip passing about said hearth rolls.

11. An apparatus as set forth in claim 10, wherein said heat-treatment furnace is a horizontal furnace.

12. An apparatus as set forth in claim 10, wherein said heat-treatment furnace is a vertical furnace.

13. An apparatus as set forth in claim 10, wherein said cooling furnace comprises successively a cooling section, an overaging treating section and a cooling section.

14. An apparatus as set forth in claim 10, wherein said heating furnace comprises successively a preheating section and a heating section.

15. An apparatus as set forth in claim 10, wherein said heat-treatment furnace is a horizontal furnace arranged above said heating furnace.

16. An apparatus as set forth in claim 10, wherein said heat-treatment furnace is a horizontal furnace arranged above said heating furnace and said cooling furnace.

* * * * *